US008192146B2

(12) United States Patent
Liang

(10) Patent No.: US 8,192,146 B2
(45) Date of Patent: Jun. 5, 2012

(54) TURBINE BLADE DUAL CHANNEL COOLING SYSTEM

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 607 days.

(21) Appl. No.: 12/397,788

(22) Filed: Mar. 4, 2009

(65) Prior Publication Data

US 2010/0226789 A1 Sep. 9, 2010

(51) Int. Cl.
*F03B 11/00* (2006.01)

(52) U.S. Cl. ..... 415/115; 416/96 R; 416/96 A; 416/97 R

(58) Field of Classification Search ..... 415/115; 416/96 R, 96 A, 97 R
See application file for complete search history.

(56) References Cited

U.S. PATENT DOCUMENTS

| | | | | |
|---|---|---|---|---|
| 5,472,316 | A * | 12/1995 | Taslim et al. | 416/97 R |
| 5,591,007 | A | 1/1997 | Lee et al. | |
| 5,813,836 | A | 9/1998 | Starkweather | |
| 5,997,251 | A | 12/1999 | Lee | |
| 6,126,396 | A | 10/2000 | Doughty et al. | |
| 6,164,914 | A | 12/2000 | Correia et al. | |
| 6,206,638 | B1 | 3/2001 | Glynn et al. | |
| 6,220,817 | B1 | 4/2001 | Durgin et al. | |
| 6,224,336 | B1 | 5/2001 | Kercher | |
| 6,290,462 | B1 | 9/2001 | Ishiguro et al. | |
| 6,471,479 | B2 | 10/2002 | Starkweather | |
| 7,168,921 | B2 | 1/2007 | Honkomp et al. | |
| 7,249,934 | B2 | 7/2007 | Palmer et al. | |
| 7,377,747 | B2 | 5/2008 | Lee | |
| 7,435,053 | B2 | 10/2008 | Liang | |
| 7,762,774 | B2 * | 7/2010 | Liang | 416/97 R |
| 2006/0051208 | A1 * | 3/2006 | Lee et al. | 416/97 R |
| 2008/0080979 | A1 | 4/2008 | Brassfield et al. | |

FOREIGN PATENT DOCUMENTS

EP 1362982 A1 11/2003

* cited by examiner

*Primary Examiner* — Michelle Mandala

(57) ABSTRACT

A turbine blade having an internal cooling system with dual serpentine cooling channels in communication with tip cooling channels is disclosed. In at least one embodiment, the cooling system may include first and second tip cooling channels in communication with the first and second serpentine cooling channels, respectively. The first tip cooling channel may extend from the leading edge to the trailing edge and be formed from a first suction side tip cooling channel and a first pressure side tip cooling channel. The second tip cooling channel may extend from a midchord region toward the trailing edge and may be positioned between the pressure and suction sides such that the second tip cooling channel is positioned generally between the first suction side and pressure side tip cooling channels. The first and second tip cooling channels may exhaust cooling fluids through the trailing edge.

20 Claims, 4 Drawing Sheets

TURBINE BLADE DUAL CHANNEL COOLING SYSTEM

FIELD OF THE INVENTION

This invention is directed generally to turbine blades, and more particularly to cooling systems in hollow turbine blades.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion at one end and an elongated portion forming a blade that extends outwardly from a platform coupled to the root portion at an opposite end of the turbine blade. The blade is ordinarily composed of a tip opposite the root section, a leading edge, and a trailing edge. The inner aspects of most turbine blades typically contain an intricate maze of cooling channels forming a cooling system. The cooling channels in the blades receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade. Often times, localized hot spots form in the tip section of turbine blades. Thus, a need exists for removing excessive heat in the tip section of turbine blades.

SUMMARY OF THE INVENTION

This invention relates to a turbine blade cooling system for turbine blades used in turbine engines. In particular, the turbine blade cooling system includes a cavity positioned between two or more walls forming a housing of the turbine blade. The cooling system may be formed from first and second cooling channels positioned in internal aspects of the blade and in communication with first and second tip cooling channels, respectively. The first and second tip cooling channels provide cooling to the tip aspects of the turbine blade to prevent temperature overages and blade damage.

The turbine blade may be formed from a generally elongated blade having a leading edge, a trailing edge, a tip wall at a first end, a root coupled to the blade at an end generally opposite the first end for supporting the blade and for coupling the blade to a disc, and at least one cavity forming a cooling system in the blade. The cooling system may be formed from first and second cooling channels extending throughout internal aspects of the generally elongated blade, wherein the first cooling channel extends throughout a first section between the leading edge and a midchord region and the second cooling channel extends throughout a second section between the midchord region and the trailing edge. A first tip cooling channel may be in communication with the first cooling channel and may extend along the tip from proximate to the leading edge to a position proximate to the trailing edge. A second tip cooling channel may be in communication with the second cooling channel, positioned at least partially radially inward of the first tip cooling channel and may extend generally along the tip from about the midchord region to a position proximate to the trailing edge.

In one embodiment, the first and second cooling channels may be counterflow serpentine cooling channels. The first cooling channel may be a counterflow serpentine cooling channel flowing from the midchord region towards the leading edge and may include an inlet positioned proximate to the root and an outlet at the tip that is in communication with the first tip cooling channel. The second cooling channel may be a counterflow serpentine cooling channel flowing from the trailing edge towards the midchord region and may include an inlet proximate to the root and an outlet at the tip that is in communication with the second tip cooling channel. The first and second cooling channels may include trip strips or pin fins, or both.

The first tip cooling channel may include a first suction side cooling channel that extends from the leading edge to the trailing edge generally along the suction side of the airfoil and a first pressure side cooling channel that extends from the leading edge to the trailing edge generally along the pressure side of the airfoil. The first suction side and pressure side cooling channels may include a plurality of micro pin fins. A plurality of orifices may extend between the first suction side cooling channel and the suction side, and a plurality of orifices may extend between the first pressure side cooling channel and the pressure side. In one embodiment, the first suction side cooling channel and the first pressure side cooling channel may merge at the trailing edge to form a single channel.

The second tip cooling channel may have a cross-sectional area at the inlet that is greater than a cross-sectional area at the trailing edge. The second tip cooling channel may also include a plurality of micro pin fins and a plurality of orifices extending between the second tip cooling channel and the suction side. The second tip cooling channel may also include a plurality of orifices extending between the second tip cooling channel and the pressure side. The orifices proximate to the suction side may be offset chordwise from the orifices on the pressure side.

An advantage of this invention is that the turbine blade cooling system presents a unique turbine blade tip section peripheral cooling system in conjunction with the cooling supply serpentine flow circuitry for the turbine airfoil cooling that greatly increase serpentine flow channel performance, which results in the reduction of airfoil metal temperature as well as reduction of cooling flow requirements and improved turbine efficiency.

Another advantage of this invention is that the tip cooling system can be used in a blade cooling design to optimize the Mach number of the serpentine channel and for use with industrial turbine engines that have thick or low conductivity TBC with reduced cooling flow.

Yet another advantage of this invention is that the dual serpentine cooling channels increase the Mach number in the last legs of the cooling channels, which increase the through flow velocity of the cooling fluids and increase the cooling side internal heat transfer coefficient.

Another advantage of this invention is that the forward flowing cooling channels in cooperation with the tip cooling channels, maximize the cooling fluid potential, the use of the tip cooling channels and tailor the airfoil external heat load.

Still another advantage of this invention is that the cooling fluids are used as internal cooling fluids and then to form external protective film layers.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
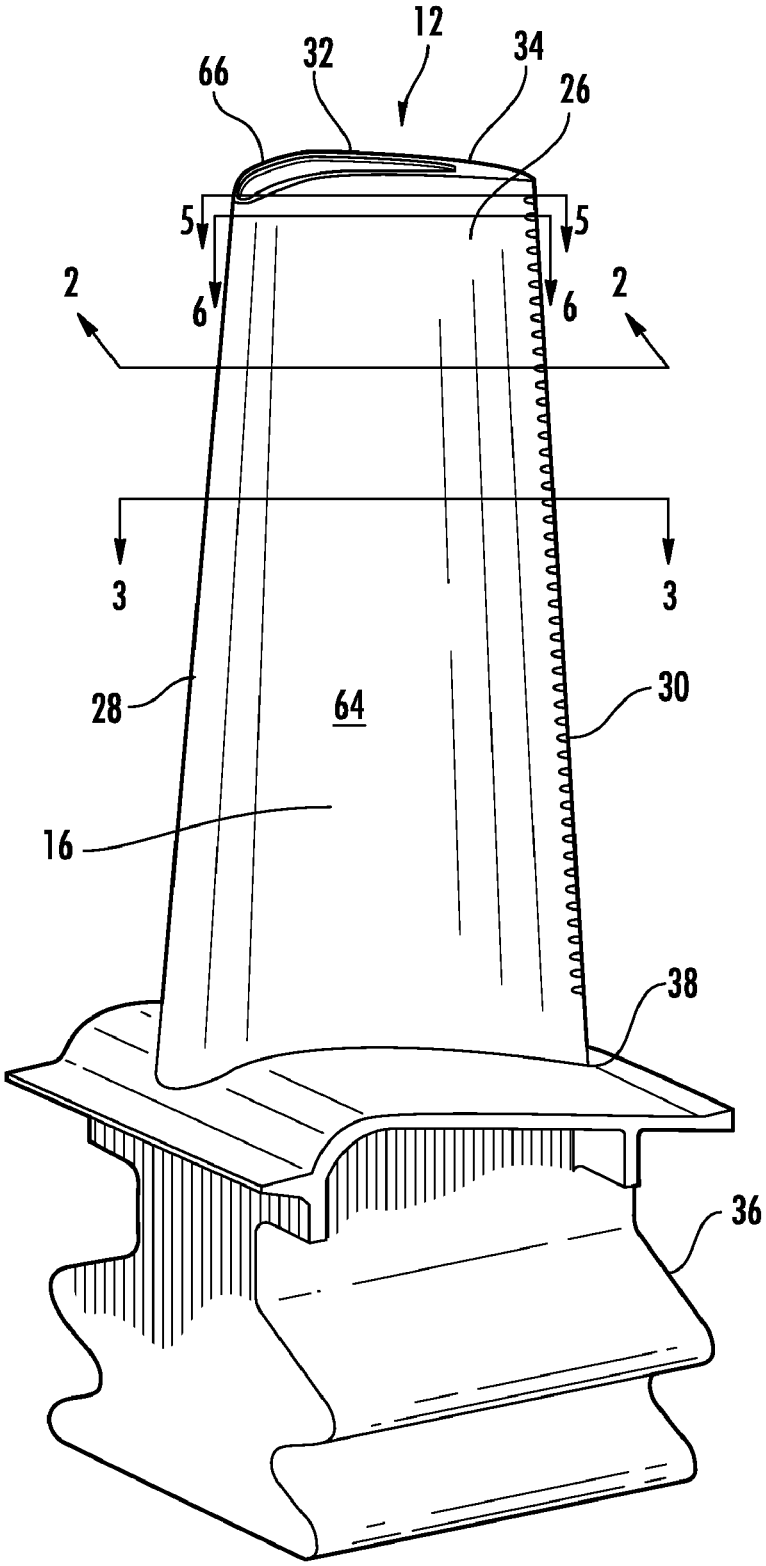
FIG. 1 is a perspective view of a turbine blade having features according to the instant invention.
Figure 2:
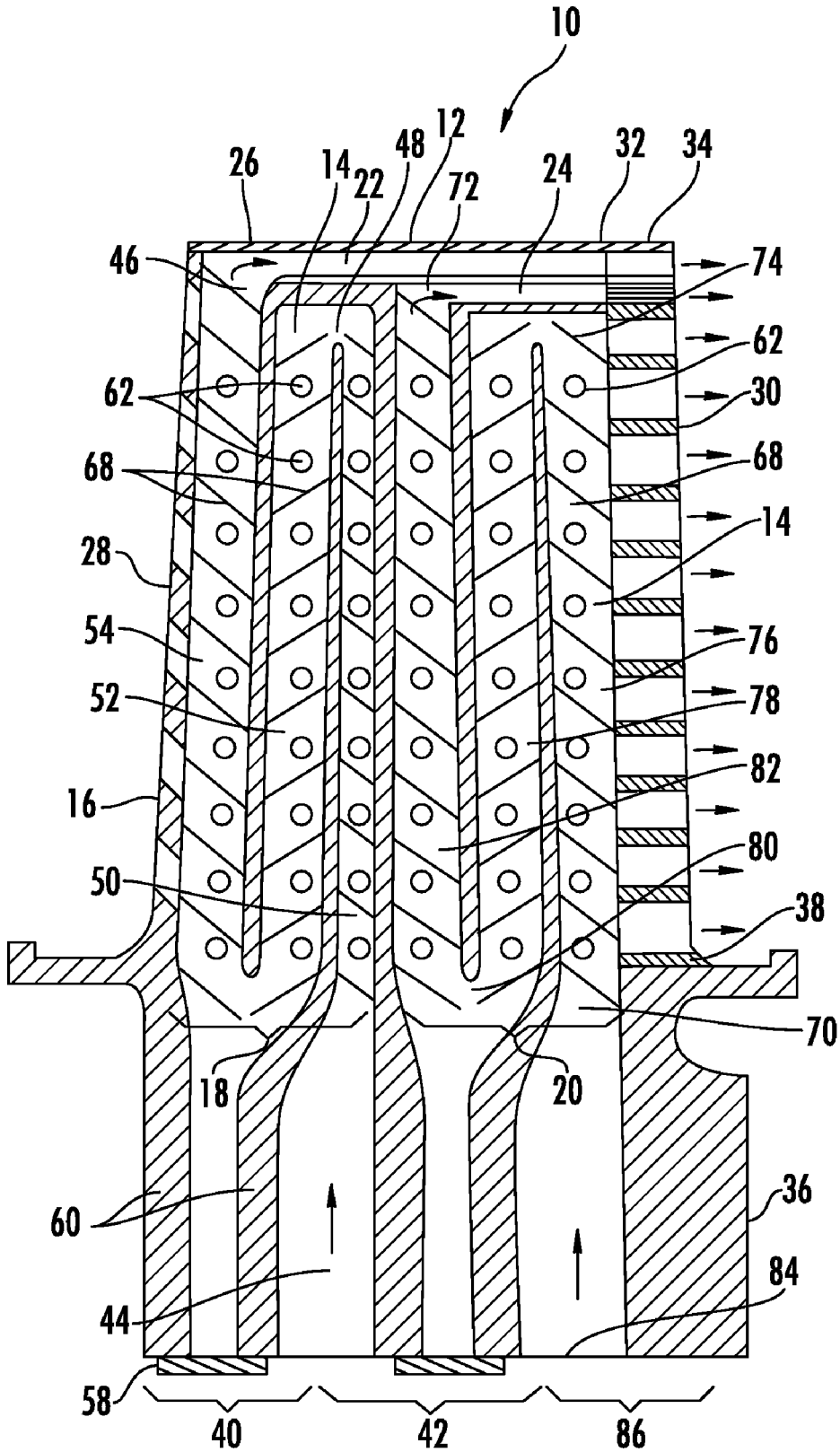
FIG. 2 is cross-sectional view, referred to as a fillet view, of the turbine blade of FIG. 1 taken along section line 2-2.
Figure 3:
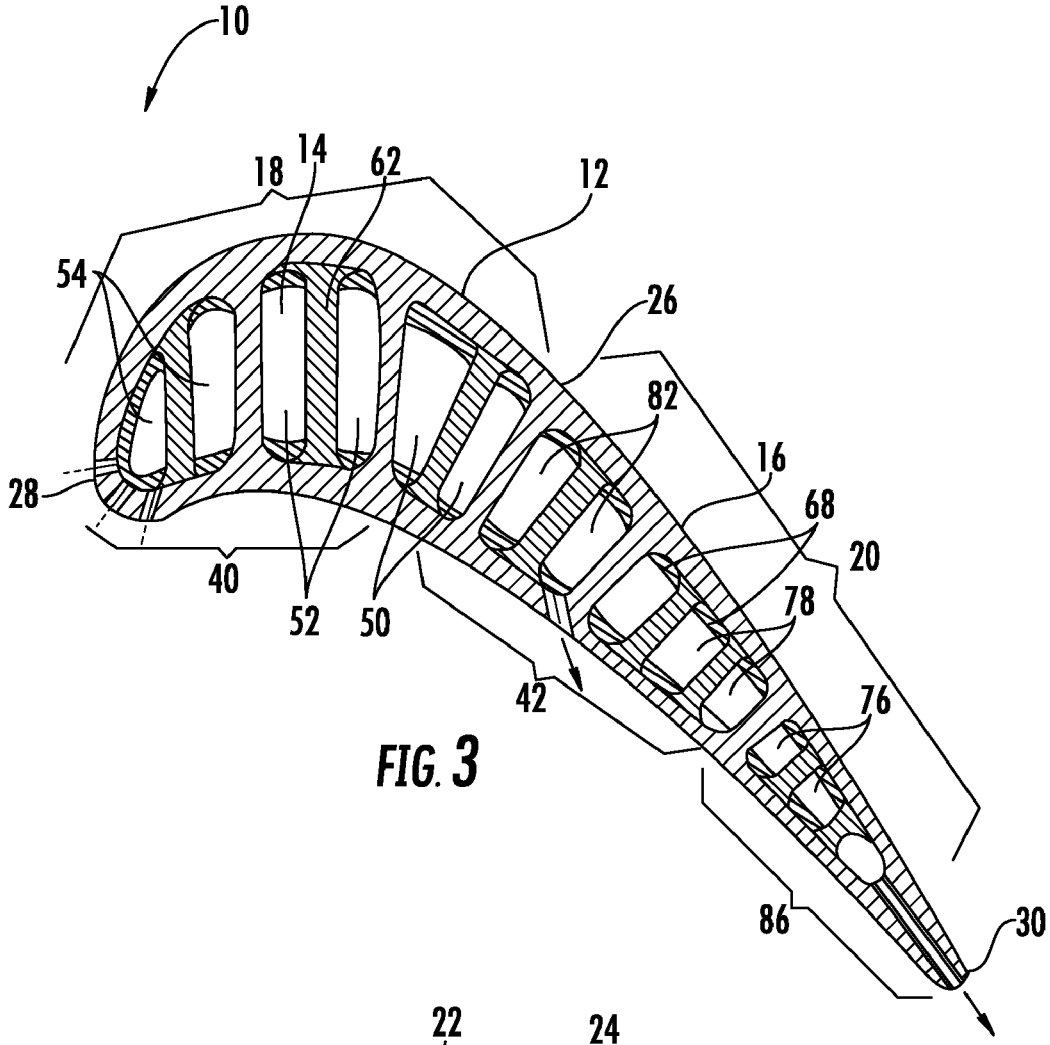
FIG. 3 is a cross-sectional view of the turbine blade taken along section line 3-3 in FIG. 1.
Figure 4:
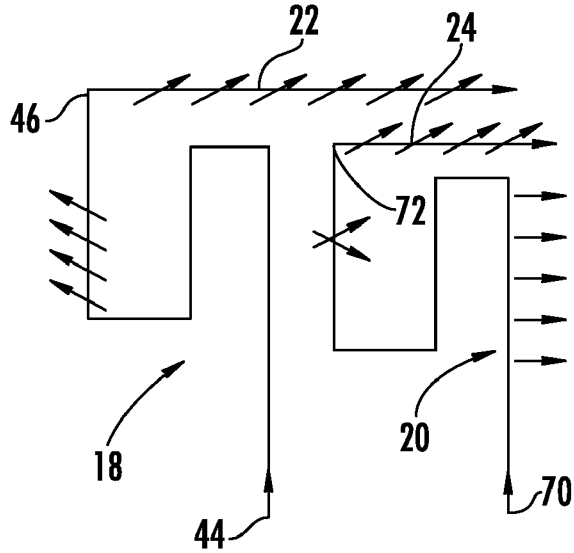
FIG. 4 is a schematic diagram of the flow scheme of the cooling system.

As shown in FIGS. 1-6, this invention is directed to a turbine blade cooling system 10 for turbine blades 12 used in turbine engines. In particular, the turbine blade cooling system 10 includes a cavity 14, as shown in FIGS. 2 and 3, positioned between two or more walls forming a housing 16 of the turbine blade 12. The cooling system 10 may be formed from first and second cooling channels 18, 20 positioned in internal aspects of the blade 12 and in communication with first and second tip cooling channels 22, 24, respectively. The first and second tip cooling channels 22, 24 provide cooling to the tip aspects of the turbine blade 12 to prevent temperature overages and blade damage.

As shown in FIG. 1, the turbine blade 12 may be formed from a generally elongated blade 26 having the leading edge 28, the trailing edge 30, a tip 32 at a first end 34, a root 36 coupled to the blade 26 at an end 38 generally opposite the first end 34 for supporting the blade 26 and for coupling the blade 26 to a disc, and the at least one cavity 14 forming the cooling system 10 in the blade 26. The cooling system 10 may have any appropriate configuration within internal aspects of the elongated blade 26.

In at least one embodiment, as shown in FIGS. 2 and 3, the cooling system 10 may be formed from first and second cooling channels 18, 20 positioned within the turbine blade 12. The cooling channels 18, 20 may be configured as serpentine cooling channels, such as, but not limited to, three pass serpentine cooling channels. The first and second cooling channels 18, 20 may discharge cooling fluids into the first and second tip cooling channels 22, 24 whereby the cooling fluids provide backside impingement cooling to the leading edge squealer pocket wall. The first cooling channel 18 may extend throughout a first section 40 between the leading edge 28 and a midchord region 42. The first cooling channel 18 may include an inlet 44 proximate to the root 36. The first cooling channel 18 may have a counterflow configuration such that the inlet 44 is positioned closer to the trailing edge 30 than an outlet 46. The first cooling channel 18 may extend from an inlet radially outwardly toward the tip 32. A first turn 48 may couple a first pass 50 directed radially outwardly with a second pass 52 directed radially inwardly. The first pass 50 may be positioned in the midchord region 42 to provide cooling fluids to an area where the external heat load is the lowest to preheat the cooling fluids. A second turn 56 may couple the second pass 52 with a third pass 54 directed radially outward that is in communication with the outlet 46. The second turn 56 may be formed from a cover plate 58 at the radially inwardmost portion of the root 36 and adjacent ribs 60.

The first cooling channel 18 may include pin fins 62 extending between an internal surface of a wall forming a pressure side 64 and an internal surface of a wall forming a suction side 66 opposite to the pressure side 64. The pin fins 62 may be positioned in the midpoint of the channel created by the first cooling channel 18 or in other appropriate positions. The pin fins 62 may have any appropriately shaped cross-sectional area. In one embodiment, the pin fins 62 may have generally cylindrically shaped cross-sections. The first cooling channel 18 may also include trip strips 68 protruding from the internal walls forming the pressure side 64 or suction side 66, or both. The trip strips 68 may protrude generally orthogonally from the internal surface a sufficient distance to create turbulence in the fluid flow to increase the cooling efficiency. The trip strips 68 may also be positioned nonparallel and nonothrogonal relative to the direction of fluid flow.

The second cooling channel 20 may include an inlet 70 proximate to the root 36. The second cooling channel 20 may have a counterflow configuration such that the inlet 70 is positioned closer to the trailing edge 30 than an outlet 72. The second cooling channel 20 may extend throughout a second section 86 between the trailing edge 30 and a midchord region 42. The second cooling channel 20 may extend from an inlet radially outwardly toward the tip 32. A first turn 74 may couple a first pass 76 directed radially outwardly with a second pass 78 directed radially inwardly. A second turn 80 may couple the second pass 78 with a third pass 82 directed radially outward that is in communication with the outlet 72. The second turn 80 may be formed from a cover plate 84 at the radially inwardmost portion of the root 36 and adjacent ribs 60.

The second cooling channel 20 may include pin fins 62 extending between the internal surface forming the pressure side 64 and the internal surface forming the suction side 66. The pin fins 62 may be positioned in the midpoint of the channel created by the second cooling channel 20 or in other appropriate positions. The pin fins 62 may be configured as discussed in regards to the first cooling channel 18. The second cooling channel 20 may also include trip strips 68 protruding from the internal walls forming the pressure side 64 or suction side 66, or both. The trip strips 68 may protrude generally orthogonally from the internal surface a sufficient distance to create turbulence in the fluid flow to increase the cooling efficiency. The trip strips 68 may also be positioned nonparallel and nonothrogonal relative to the direction of fluid flow.

Figure 5:
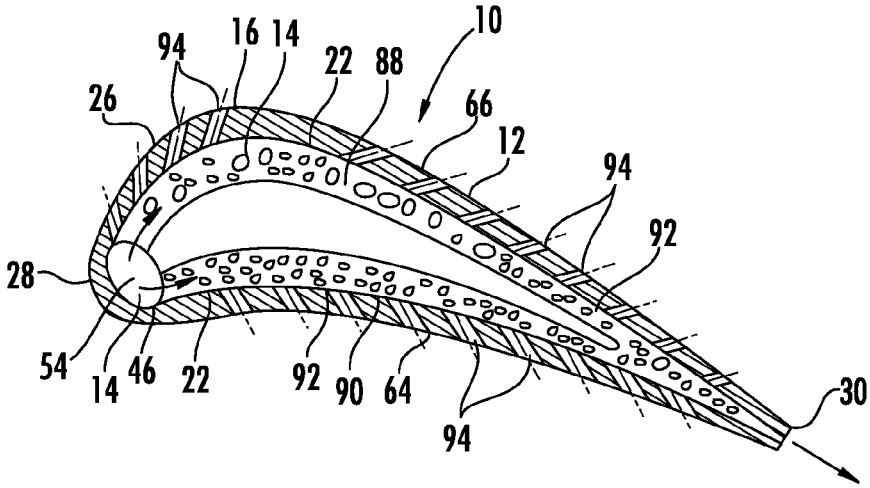
FIG. 5 is a cross-sectional view of a tip of the turbine blade taken at section line 5-5 in FIG. 1.

The first tip cooling channel 22, as shown in FIG. 5, may include a first suction side cooling channel 88 that extends from the leading edge 28 to the trailing edge 30 generally along the suction side 66 of the airfoil 26 and a first pressure side cooling channel 90 that extends from the leading edge 28 to the trailing edge 30 generally along the pressure side 64 of the airfoil 26. The first suction side cooling channel 88 and the first pressure side cooling channel 90 may have any appropriate size and configuration, such as differently configured cross-sections. The first suction side cooling channel 88 and the first pressure side cooling channel 90 may include a plurality of micro pin fins 92 that are configured and sized to fit within the first suction side and pressure side cooling channels 88, 90. A plurality of orifices 94 may extend between the first suction side cooling channel 88 and the suction side 66, and a plurality of orifices 94 may extend between the first pressure side cooling channel 90 and the pressure side 64. The first suction side cooling channel 88 and the first pressure side cooling channel 90 merge at the trailing edge 30.

Figure 6:
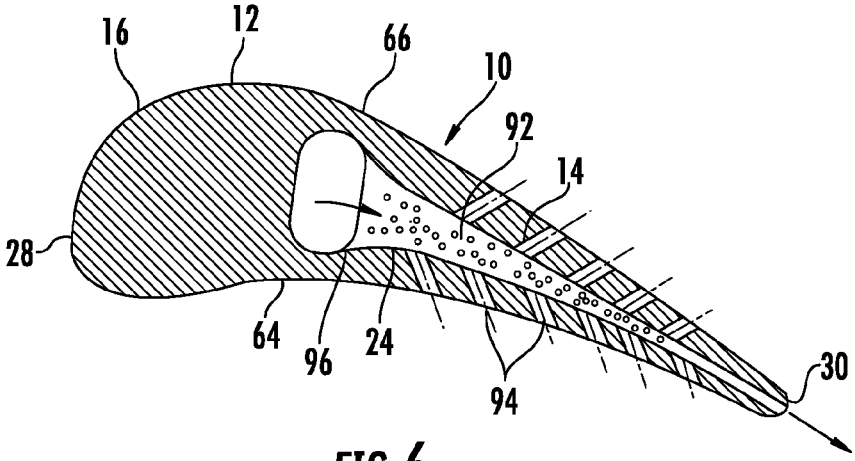
FIG. 6 is a cross-sectional view of a tip of the turbine blade taken at section line 6-6 in FIG. 1.

The second tip cooling channel 24 may have a cross-sectional area at the inlet 96 that is greater than a cross-sectional area at the trailing edge 30, as shown in FIG. 6. The second tip cooling channel 24 may also include a plurality of micro pin fins 92 and a plurality of orifices 94 extending between the second tip cooling channel 24 and the suction side 66 and a plurality of orifices 94 extending between the second tip cooling channel 24 and the pressure side 64. The orifices 94 proximate to the suction side 66 may be offset chordwise from the orifices 94 on the pressure side 64, as shown in FIG. 6.

During operation, cooling fluids, which may be, but are not limited to, air, flow into the cooling system 10 from a cooling supply system upstream of the root 36 in the cooling system. The cooling fluids flow into the inlets 44 and 70 and into the first and second cooling channels 18, 20, respectively. The flow of the cooling fluids is generally back and forth from the root 36 to the tip 32 and generally from a direction from the trailing edge 30 toward the leading edge 28, which is referred to as counterflow. Such counterflow allows the cooling fluids to be preheated in areas of low thermal stress and be used in areas of high thermal stress after being preheated to prevent the formation of large thermal gradients, which can cause blade damage. The cooling fluids may flow past pin fins 62 and trip strips 68, which increase the thermal efficiency of the cooling system 10. The cooling fluids may be exhausted into the first and second tip cooling channels 22, 24.

In operation, the majority of the tip section cooling fluids are not discharged from the turbine first and second serpentine cooling channels 18, 20 when the fluids reach the outlets 46, 72. As a result, the majority of the tip cooling air is channeled through the serpentine flow channels 18, 20 to enhance the serpentine flow channels 18, 20 internal through flow Mach number, which equates to a higher internal heat transfer coefficient for the channels 18, 20, and greatly increases the internal cooling performance of the serpentine cooling channels 18, 20.

The cooling fluids may then be exhausted into the first and second tip cooling channels 22, 24. The cooling fluids may flow through the channels 22, 24 and impinge on the micro pin fins 92 positioned therein. The channels 22, 24 run generally along the backside of the squealer tip 32, thereby providing backside cooling to the tip 32. The cooling fluids may be exhausted through orifices 94 to enhance formation of and to supplement a film cooling fluid layer. Cooling fluids may also be exhausted through orifices in the trailing edge 30.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine blade, comprising:

a generally elongated blade having a leading edge, a trailing edge, a tip at a first end, a root coupled to the blade at an end generally opposite the first end for supporting the blade and for coupling the blade to a disc, and at least one cavity forming a cooling system in the blade;

wherein the cooling system is formed from first and second cooling channels extending throughout internal aspects of the generally elongated blade, wherein the first cooling channel extends throughout a first section between the leading edge and a midchord region and the second cooling channel extends throughout a second section between the midchord region and the trailing edge;

a first tip cooling channel in communication with the first cooling channel and extending along the tip from proximate to the leading edge to a position proximate to the trailing edge; and a second tip cooling channel in communication with the second cooling channel, positioned at least partially radially inward of the first tip cooling channel such that at least a portion of the first tip cooling channel is positioned between the tip and second tip cooling channel, and the second cooling channel extends generally along the tip from about the midchord region to a position proximate to the trailing edge.

2. The turbine blade of claim 1, wherein the first and second cooling channels are counterflow serpentine cooling channels.

3. The turbine blade of claim 2, wherein the first cooling channel is a counterflow serpentine cooling channel flowing from the midchord region towards the leading edge and including an inlet proximate to the root and an outlet at the tip that is in communication with the first tip cooling channel.

4. The turbine blade of claim 2, wherein the second cooling channel is a counterflow serpentine cooling channel flowing from the trailing edge towards the midchord region and including an inlet proximate to the root and an outlet at the tip that is in communication with the second tip cooling channel.

5. The turbine blade of claim 2, wherein the first cooling channel comprises trip strips.

6. The turbine blade of claim 5, wherein the second cooling channel comprises trip strips.

7. The turbine blade of claim 2, wherein the first cooling channel comprises pin fins in at least a portion of the first cooling channel.

8. The turbine blade of claim 7, wherein the second cooling channel comprises pin fins in at least a portion of the first cooling channel.

9. The turbine blade of claim 1, wherein the first tip cooling channel comprises a first suction side cooling channel that extends from the leading edge to the trailing edge generally along the suction side of the blade and a first pressure side cooling channel that extends from the leading edge to the trailing edge generally along the pressure side of the blade.

10. The turbine blade of claim 9, wherein the first suction side cooling channel comprises a plurality of micro pin fins.

11. The turbine blade of claim 9, wherein the first pressure side cooling channel comprises a plurality of micro pin fins.

12. The turbine blade of claim 9, further comprising a plurality of orifices extending between the first suction side cooling channel and the suction side and a plurality of orifices extending between the first pressure side cooling channel and the pressure side.

13. The turbine blade of claim 9, wherein the first suction side cooling channel and the first pressure side cooling channel merge at the trailing edge.

14. The turbine blade of claim 1, wherein the second tip cooling channel has a cross-sectional area at the inlet that is greater than a cross-sectional area at the trailing edge.

15. The turbine blade of claim 14, wherein the second tip cooling channel further comprises a plurality of micro pin fins and a plurality of orifices extending between the second tip cooling channel and the suction side and a plurality of orifices extending between the second tip cooling channel and the pressure side; wherein the orifices proximate to the suction side are offset chordwise from the orifices on the pressure side.

16. A turbine blade, comprising:

a generally elongated blade having a leading edge, a trailing edge, a tip at a first end, a root coupled to the blade at an end generally opposite the first end for supporting the blade and for coupling the blade to a disc, and at least one cavity forming a cooling system in the blade;

wherein the cooling system is formed from first and second serpentine cooling channels extending throughout internal aspects of the generally elongated blade, wherein the first serpentine cooling channel extends throughout a first section between the leading edge and a midchord region and the second serpentine cooling channel extends throughout a second section between the midchord region and the trailing edge;

a first tip cooling channel in communication with the first serpentine cooling channel and extending along the tip from proximate to the leading edge to a position proximate to the trailing edge, wherein the first cooling channel is a counterflow serpentine cooling channel flowing from the midchord region towards the leading edge and including an inlet proximate to the root and an outlet at the tip that is in communication with the first tip cooling channel; and a second tip cooling channel in communication with the second serpentine cooling channel, positioned at least partially radially inward of the first tip cooling channel and extending generally along the tip from about the midchord region to a position proximate to the trailing edge, wherein the second cooling channel is a counterflow serpentine cooling channel flowing from the trailing edge towards the midchord region and including an inlet proximate to the root and an outlet at the tip that is in communication with the second tip cooling channel;

wherein the first and second cooling channels are counterflow serpentine cooling channels;

wherein the first and second cooling channel have trip strips and pin fins;

wherein the first tip cooling channel comprises a first suction side cooling channel that extends from the leading edge to the trailing edge generally along the suction side of the blade and a first pressure side cooling channel that extends from the leading edge to the trailing edge generally along the pressure side of the blade; and a plurality of orifices extending between the first suction side cooling channel and the suction side and a plurality of orifices extending between the first pressure side cooling channel and the pressure side.

17. The turbine blade of claim 16, wherein the first suction and first pressure side cooling channels comprise a plurality of micro pin fins.

18. The turbine blade of claim 16, wherein the first suction side cooling channel and the first pressure side cooling channel merge at the trailing edge.

19. The turbine blade of claim 16, wherein the second tip cooling channel has a cross-sectional area at the inlet that is greater than a cross-sectional area at the trailing edge.

20. The turbine blade of claim 19, wherein the second tip cooling channel further comprises a plurality of micro pin fins and a plurality of orifices extending between the second tip cooling channel and the suction side and a plurality of orifices extending between the second tip cooling channel and the pressure side; wherein the orifices proximate to the suction side are offset chordwise from the orifices on the pressure side.

* * * * *